United States Patent [19]

Savin et al.

[11] Patent Number: 4,475,250

[45] Date of Patent: Oct. 9, 1984

[54] DISPOSABLE BIB

[76] Inventors: Bruce A. Savin; Hollis C. Savin, both of 27 Stonewood Ct., Racine, Wis. 53402

[21] Appl. No.: 488,419

[22] Filed: Apr. 25, 1983

[51] Int. Cl.[3] ..... A41B 13/10

[52] U.S. Cl. ..... 2/49 R; 2/52

[58] Field of Search ..... 2/49 R, 52, 50, 48, 2/51

[56] References Cited

U.S. PATENT DOCUMENTS 2,580,388 1/1952 Allen ..... 2/49 R 3,452,363 7/1969 Schultz ..... 2/49 R 3,979,776 9/1976 Gruenwald ..... 2/49 R

*Primary Examiner*—Doris L. Troutman

*Attorney, Agent, or Firm*—Andrus, Sceales, Starke & Sawall

[57] ABSTRACT

A disposable bib includes a body of flexible sheet material having a neck opening formed therein and a pair of tear away tie strips. The sheet material includes a waterproof layer on one side thereof constructed of a thermoplastic resin, and an absorbent layer on the other side thereof constructed of randomly orientated non-woven synthetic and/or natural fibers.

5 Claims, 3 Drawing Figures

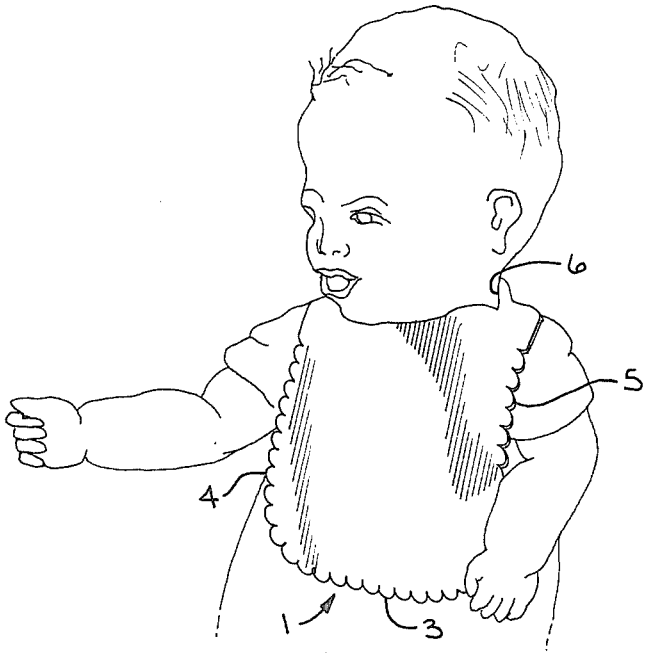
FIG.1
FIG.2
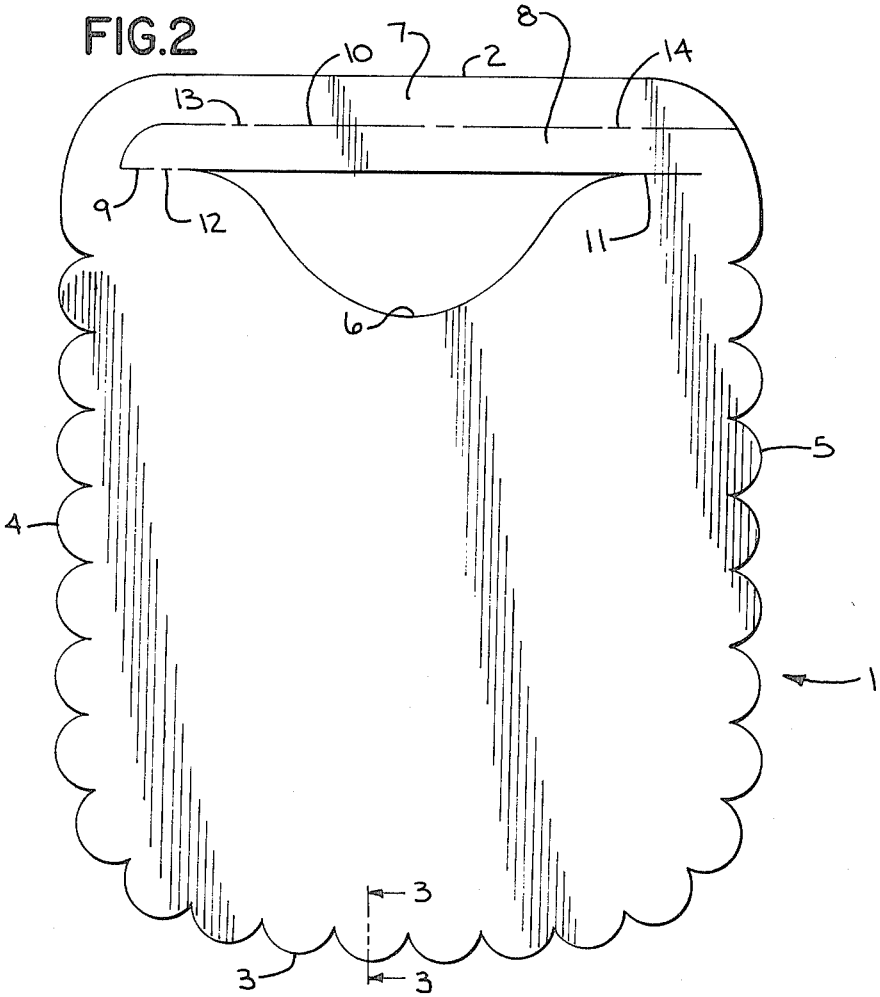
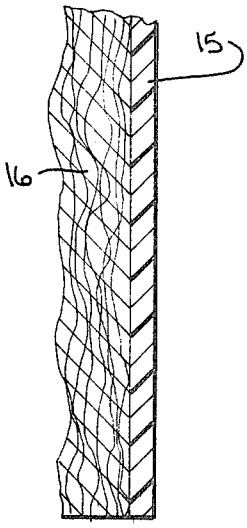
FIG.3

DISPOSABLE BIB

BACKGROUND OF THE INVENTION

The present invention relates to bibs, and more particularly to disposable bibs.

Protective garments in the form of bibs which are tied around a user's neck are well known in the art. Such bibs may be either reusable, as exemplified by U.S. Pat. No. 3,407,407, or may be disposable, as exemplified by U.S. Pat. Nos. 3,416,157 and 3,452,363. Such bibs, however, are relatively expensive to manufacture and if constructed of paper or thin plastic may be easily torn apart by an infant. Further, an infant may chew on and ingest bits or pieces of such materials causing possible choking or other harm.

Tie-less bibs which are passed over a user's head are also well known in the art as evidenced by U.S. Pat. No. 3,404,407. This type of bib, however, is comprised of a sheet of stretchable polyurethane which, like thin plastic and paper, may be torn easily and eaten by an infant. Another type of tie-less bib which utilizes adhesive for placement of the bib against the clothing or body of a user is shown in U.S. Pat. Nos. 4,288,877, 4,306,316 and 4,330,888.

None of the above known prior art bibs, however, offer the unique features of the present invention.

SUMMARY OF THE INVENTION

A disposable bib comprising a body of flexible sheet material having a neck opening formed therein. The sheet material includes a waterproof layer on one side thereof and an absorbent layer of randomly orientated non-woven synthetic and/or natural fibers on the other side thereof.

The waterproof layer is composed of a thermoplastic resin such as polyethylene, polypropylene or polyurethane, and the fibrous material of the absorbent layer may be for example polyester or a mixture of polyester and cellulose. The non-woven characteristic of the fibrous material provides a layer having a soft, nappy, absorbent surface on one side, and a smooth surface on the reverse side which is coated with the thermoplastic resin. Such a combination of materials provides a bib that cannot be easily torn, ripped or eaten by an infant, and provides adequate protection from spilled liquids or solids yet acts as a moisture or water barrier which prevents liquids from soaking through to the user's garments.

A cut line having perforated portions is also formed in the body of flexible sheet material to define a pair of tear away tie strips for tying the bib about the user's neck.

The bib is inexpensive and easy to manufacture. The bib is fabricated by an extrusion coating process wherein the thermoplastic resin is extruded through a sheet die onto the smooth side of the non-woven absorbent layer substrate to form the flexible sheet material. The coating of the smooth side or back of the substrate provides a material with a soft, absorbent surface on one side, yet waterproof on the reverse side. A die is then utilized to stamp the bib from the flexible sheet material and simultaneously to provide the neck opening and tie strips.

The present invention thus provides a disposable bib which cannot be easily torn or eaten by an infant, is soft and absorbent yet provides adequate protection to the wearer, and is inexpensive and easy to manufacture.

BRIEF DESCRIPTION OF THE DRAWINGS

The drawings illustrate the best mode presently contemplated of carrying out the invention.

In the drawings:

FIG. 1 is a perspective view illustrating an infant utilizing a disposable bib constructed in accordance with the principles of the present invention;

FIG. 2 is a plan view of the bib shown in FIG. 1; and

FIG. 3 is a cross sectional view taken along the plane of the line 3—3 of FIG. 2.

DESCRIPTION OF THE PREFERRED EMBODIMENT

Referring now to the drawings, FIGS. 1 and 2 illustrate a disposable bib, designated generally by the numeral 1, constituting a preferred embodiment of the present invention. As shown, bib 1 is dimensioned to fully protect the wearer's chest. For use with an infant, as in the illustrated embodiment, bib 1 is approximately 10 inches wide and 12 inches long. However, it is to be understood that bib 1 is not limited to use with infants, but may also be utilized with adults. Thus, the present invention is not limited to a bib having the specific dimensions illustrated or described.

It should also be noted that bib 1 is not limited to the shape illustrated in FIG. 1, but may also be a protective garment in the form of a napkin, apron or the like.

Bib 1 includes a top edge 2, a bottom edge 3 and a pair of opposite longitudinal side edges 4 and 5. As shown, edges 3–5 are scalloped to form an ornamental design.

Bib 1 includes a U-shaped aperture or neck opening 6 formed therein at its upper end. Neck opening 6 is located adjacent to but spaced from top edge 2 and defines an upper edge margin portion extending transversely across the top of bib 1. A cut line divides the upper edge margin portion into a pair of tie strips 7 and 8 for tying bib 1 about the neck of a user. The cut line includes a first portion 9 which extends from the upper lefthand corner of neck opening 6 transversely to a point adjacent to but spaced from the lefthand side edge 4. The cut line also includes a second portion 10 which extends from the end of first portion 9 upwardly and then transversely across bib 1 to communicate with the righthand side edge 5. A third portion 11 of the cut line extends from the upper righthand corner of neck opening 6 transversely to a point adjacent to but spaced from side edge 5. This third portion 11 functions to provide a neck opening 6 which is expandable to fit various size necks. As shown, portions 9–11 are substantially parallel to top edge 2 with the transverse section of portion 10 dividing the upper edge margin in half to provide two identical tie strips 7 and 8.

Portion 9 of the cut line is perforated as at 12, and portion 10 is perforated at a first location 11 adjacent to the left side edge 4 and at a second location 14 adjacent to the right side edge 5. Perforations 12–14 enable tie strips 7 and 8 to be easily torn away from the body of bib 1 just prior to use.

Referring now to FIG. 3, bib 1 is constructed of a body of flexible sheet material which includes a waterproof layer 15 on the bottom side thereof, and an absorbent layer 16 on the top side thereof. Waterproof layer 15 is composed of a thermoplastic resin, such as polyethylene, polypropylene or polyurethane. The thickness of layer 15 is preferably between about 0.25 to about 1.25 mils.

Absorbent layer 16 is composed of a sheet of non-woven, randomly orientated, continuous, synthetic and/or natural fibers, such as polyester fibers, rayon fibers or a mixture of polyester and cellulose fibers. For example, one type of material which may be utilized as the absorbent layer 16 is available from the International Paper Co. The non-woven material, due to the continuous and randomly orientated nature of the fibers, provides sufficient strength for layer 16 so that it will not rip or tear easily. To provide the desired strength, layer 16 has a weight in the range of 0.25 to 1.5 grams per square yard, and a thickness of between 6 to 30 mils with a preferred thickness of 14 to 22 mils.

The physical characteristics of the non-woven fibers provides a sheet of material with a relatively smooth surface on one side and soft nap on its other side. As shown in FIG. 3, the smooth surface is positioned adjacent to layer 15 so that in use layer 15 faces the clothing or body of a user while the nap side faces outwardly to provide softness and adequate protection from spilled liquids or solids.

Bib 1 is extremely simple to manufacture and is fabricated by an extrusion coating process. Layer 15 of thermoplastic resin is extruded through a sheet die onto the smooth surface of the substrate layer 16 to form the flexible sheet material. This material is then stamped with a die which simultaneously sections bib 1 into the desired dimensions and provides the neck opening 6 and tie strips 7 and 8.

In use, tie strips 7 and 8 are first torn away from the body of bib 1 along perforations 12–14. The body of bib 1 is then placed over the wearer's chest so that neck opening 6 abuts against the front of the wearer's neck so that spilled liquids or solids will be caught by bib 1. Tie strips 7 and 8 are then tied behind the wearer's neck to hold bib 1 in position. As shown, bib 1 starts at approximately the front of the neck of the wearer and ends at a desired position, such as approximately in the middle of the wearer's abdomen.

A disposable bib 1 has been illustrated and described which includes a waterproof layer 15 on one side of thermoplastic resin and an absorbent layer 16 on the other side of randomly orientated, non-woven fibers. The bib will not easily rip or tear, is comfortable to wear, is soft and absorbent and yet provides adequate protection against spills and moisture to the wearer while being inexpensive and easy to manufacture.

Various modes of carrying out the invention are contemplated as being within the scope of the following claims particularly pointing out and distinctly claiming the subject matter which is regarded as the invention.

We claim:

1. A disposable bib, comprising a body of flexible sheet material having a top edge, a bottom edge and opposite side edges, said body having a neck opening formed therein at its upper end spaced from said top edge that defines a transversely extending upper edge margin portion and a cut line formed in said margin portion for providing a pair of tie stips for tying said body around a neck, a first portion of said cut line communicating with said opening and extending transversly therefrom to a point adjacent to and spaced from one of said side edges, and a second portion of said cut line extending upwardly from said point and transversely across said portion to communicate with the other of said side edges, said sheet material including a waterproof layer on one side thereof and an absorbent layer of randomly orientated non-woven fibers on the other side thereof.

2. The disposable bib of claim 1, wherein said cut line includes a third portion communicating with said neck opening at a location opposite from that of said first portion and extending transversely therefrom to a point adjacent to and spaced from the other of said side edges.

3. The disposable bib of claim 2, wherein said first portion, the transverse section of said second portion, and said third portion all extend parallel to said top edge.

4. The disposable bib of claim 1, wherein said neck opening is substantially U-shaped.

5. The disposable bib of claim 1, wherein the first portion of said cut line is perforated and the second portion of said cut line is perforated at a first location adjacent to said one side edge and at a second location adjacent to said other side edge to define a pair of tear away tie strips.

* * * * *